US012486086B2

(12) United States Patent
Kleyn

(10) Patent No.: US 12,486,086 B2
(45) Date of Patent: Dec. 2, 2025

(54) DISRUPTED CLOSURES FOR CONTAINERS AND METHODS OF MANUFACTURE

(71) Applicant: Selig Grand Rapids LLC, Grand Rapids, MI (US)

(72) Inventor: Stephen Bernard Kleyn, Hudsonville, MI (US)

(73) Assignee: Selig Grand Rapids LLC, Grand Rapids, MI (US)

( * ) Notice: Subject to any disclaimer, the term of this patent is extended or adjusted under 35 U.S.C. 154(b) by 138 days.

(21) Appl. No.: 18/218,988

(22) Filed: Jul. 6, 2023

(65) Prior Publication Data

US 2025/0011054 A1 Jan. 9, 2025

(51) Int. Cl.
*B65D 51/16* (2006.01)
*B65D 41/04* (2006.01)
*B65D 53/04* (2006.01)

(52) U.S. Cl.
CPC ..... *B65D 51/1605* (2013.01); *B65D 41/0428* (2013.01); *B65D 41/045* (2013.01); *B65D 53/04* (2013.01)

(58) Field of Classification Search
CPC ..... B65D 1/02; B65D 1/0207; B65D 1/0215; B65D 1/0223; B65D 1/023; B65D 1/0238; B65D 1/0246; B65D 1/0253; B65D 1/0261; B65D 1/0276; B65D 1/0284; B65D 1/0292; B65D 1/04; B65D 1/06; B65D 1/08; B65D 1/095; B65D 1/10; B65D 1/12; B65D 1/16; B65D 1/165; B65D 1/20; B65D 1/22; B65D 1/225; B65D 1/24; B65D 1/26; B65D 1/265; B65D 1/28; B65D 1/32; B65D 1/323; B65D 1/34; B65D 1/36; B65D 1/40; B65D 1/42; B65D 1/44; B65D 1/46; B65D 1/48; B65D 11/02; B65D 11/04; B65D 11/06; B65D 11/08; B65D 11/10; B65D 11/18; B65D 11/1826; B65D 11/1833; B65D 11/186; B65D 11/1866; B65D 11/1873; B65D 11/20; B65D 13/02; B65D 15/02; B65D 15/06; B65D 15/08; B65D 15/14; B65D 17/02; B65D 17/08; B65D 17/12; B65D 17/28; B65D 17/32; B65D 17/34; B65D 17/353; B65D 17/401; B65D 17/4011; B65D 17/4012;

(Continued)

(56) References Cited

U.S. PATENT DOCUMENTS 3,263,850 A * 8/1966 Scott ..... B65D 51/1661 215/261
4,789,074 A * 12/1988 Han ..... B65D 53/04 428/116

(Continued)

FOREIGN PATENT DOCUMENTS

WO WO-2022140265 A1 * 6/2022 ..... B65D 51/1661

*Primary Examiner* — Anthony D Stashick
*Assistant Examiner* — Marcos Javier Rodriguez Molina
(74) *Attorney, Agent, or Firm* — Fitch, Even, Tabin & Flannery, LLP

(57) ABSTRACT

Disrupted closures are described herein which can provide for consistent flow paths for gas transfer from a container. The closures include a sealing member extending on the inside of the closure to contact a vented liner and/or the rim of a container. The sealing member includes a sealing portion and one or more disruptions in the sealing portion to provide gas pathways to the ambient atmosphere.

23 Claims, 8 Drawing Sheets

(58) Field of Classification Search
CPC ..... B65D 17/4014; B65D 17/402; B65D 17/404; B65D 17/42; B65D 17/462; B65D 17/464; B65D 17/502; B65D 17/503; B65D 17/505; B65D 17/506; B65D 17/508; B65D 19/0018; B65D 19/06; B65D 19/08; B65D 19/18; B65D 21/02; B65D 21/0201; B65D 21/0204; B65D 21/0206; B65D 21/0209; B65D 21/0212; B65D 21/0213; B65D 21/0215; B65D 21/0217; B65D 21/0219; B65D 21/022; B65D 21/0222; B65D 21/0223; B65D 21/0228; B65D 21/023; B65D 21/0231; B65D 21/0233; B65D 21/0234; B65D 21/0237; B65D 21/062; B65D 21/066; B65D 21/08; B65D 21/083; B65D 21/086; B65D 2201/00; B65D 2203/00; B65D 2203/02; B65D 2203/04; B65D 2203/06; B65D 2203/10; B65D 2203/12; B65D 2205/00; B65D 2205/02; B65D 2205/025; B65D 2207/00; B65D 2211/00; B65D 2213/00; B65D 2215/00; B65D 2215/02; B65D 2215/04; B65D 2217/00; B65D 2221/00; B65D 2231/00; B65D 2231/001; B65D 2231/004; B65D 2231/005; B65D 2231/008; B65D 2231/02; B65D 2231/022; B65D 2231/025; B65D 2251/00; B65D 2251/0003; B65D 2251/0006; B65D 2251/0012; B65D 2251/0015; B65D 2251/0018; B65D 2251/0021; B65D 2251/0025; B65D 2251/0028; B65D 2251/0031; B65D 2251/005; B65D 2251/0056; B65D 2251/0062; B65D 2251/0068; B65D 2251/0071; B65D 2251/0075; B65D 2251/0078; B65D 2251/0081; B65D 2251/0087; B65D 2251/009; B65D 2251/0093; B65D 2251/0096; B65D 2251/01; B65D 2251/02; B65D 2251/023; B65D 2251/04; B65D 2251/06; B65D 2251/08; B65D 2251/09; B65D 2251/1008; B65D 2251/1016; B65D 2251/1025; B65D 2251/1033; B65D 2251/1041; B65D 2251/105; B65D 2251/1058; B65D 2251/1066; B65D 2251/1075; B65D 2251/1091; B65D 2251/20; B65D 2251/205; B65D 2255/20; B65D 23/00; B65D 23/001; B65D 23/003; B65D 23/02; B65D 23/04; B65D 23/06; B65D 23/0814; B65D 23/0828; B65D 23/0842; B65D 23/085; B65D 23/0864; B65D 23/0871; B65D 23/0885; B65D 23/10; B65D 23/102; B65D 23/104; B65D 23/106; B65D 23/12; B65D 23/14; B65D 2301/20; B65D 2303/00; B65D 2313/02; B65D 2313/04; B65D 2401/00; B65D 2401/05; B65D 2401/10; B65D 2401/15; B65D 2401/20; B65D 2401/25; B65D 2401/30; B65D 2401/35; B65D 2401/50; B65D 2401/60; B65D 25/00; B65D 25/02; B65D 25/04; B65D 25/06; B65D 25/08; B65D 25/10; B65D 25/101; B65D 25/106; B65D 25/107; B65D 25/108; B65D 25/14; B65D 25/16; B65D 25/18; B65D 25/20; B65D 25/205; B65D 25/22; B65D 25/24; B65D 25/28; B65D 25/2802; B65D 25/2805; B65D 25/2808; B65D 25/2811; B65D 25/2817; B65D 25/282; B65D 25/2826; B65D 25/2835; B65D 25/2841; B65D 25/285; B65D 25/2852; B65D 25/2864; B65D 25/2873; B65D 25/2885; B65D 25/2894; B65D 25/2897; B65D 25/32; B65D 25/325; B65D 25/34; B65D 25/36; B65D 25/38; B65D 25/385; B65D 25/40; B65D 25/42; B65D 25/44; B65D 25/46; B65D 25/465; B65D 25/48; B65D 25/52; B65D 25/525; B65D 25/54; B65D 25/56; B65D 2501/0018; B65D 2501/0027; B65D 2501/0036; B65D 2501/0063; B65D 2501/0081; B65D 2501/24044; B65D 2501/4872; B65D 2517/0007; B65D 2517/0011; B65D 2517/0013; B65D 2517/0014; B65D 2517/0016; B65D 2517/002; B65D 2517/0025; B65D 2517/0032; B65D 2517/0034; B65D 2517/0038; B65D 2517/0041; B65D 2517/0043; B65D 2517/70044; B65D 2517/0046; B65D 2517/0049; B65D 2517/0052; B65D 2517/0053; B65D 2517/0056; B65D 2517/0061; B65D 2517/0062; B65D 2517/0071; B65D 2517/0082; B65D 2517/0086; B65D 2517/0089; B65D 2517/0091; B65D 2517/0092; B65D 2517/0094; B65D 2517/5005; B65D 2517/5016; B65D 2517/5029; B65D 2517/5032; B65D 2517/5035; B65D 2517/5056; B65D 2517/5059; B65D 2517/5075; B65D 2517/5078; B65D 2517/5081; B65D 2517/5083; B65D 2517/5091; B65D 2519/00024; B65D 2519/00029; B65D 2519/00034; B65D 2519/00044; B65D 2519/00059; B65D 2519/00064; B65D 2519/00069; B65D 2519/00164; B65D 2519/00174; B65D 2519/00184; B65D 2519/00199; B65D 2519/00208; B65D 2519/00218; B65D 2519/00233; B65D 2519/00268; B65D 2519/00273; B65D 2519/00288; B65D 2519/00293; B65D 2519/00298; B65D 2519/00318; B65D 2519/00323; B65D 2519/00333; B65D 2519/00338; B65D 2519/00422; B65D 2519/00457; B65D 2519/00497; B65D 2519/00502; B65D 2519/00557; B65D 2519/00562; B65D 2519/00567; B65D 2519/00582; B65D 2519/00611; B65D 2519/00621; B65D 2519/00626; B65D 2519/00641; B65D 2519/00666; B65D 2519/00701; B65D 2519/00711; B65D 2519/00786; B65D 2519/00796; B65D 2519/00805; B65D 2519/0081; B65D 2519/0087; B65D 2519/0094; B65D 2525/28; B65D 2525/281; B65D 2525/283; B65D 2525/285; B65D 2525/287; B65D 2539/001; B65D 2539/003; B65D 2539/006; B65D 2539/008; B65D 2543/00009; B65D 2543/00018; B65D 2543/00027; B65D 2543/00037; B65D 2543/00046; B65D 2543/00074; B65D 2543/0083; B65D 2543/00092; B65D 2543/00101; B65D 2543/0012; B65D 2543/00148; B65D 2543/00175; B65D 2543/00194; B65D 2543/00203; B65D 2543/00212; B65D 2543/00222; B65D 2543/00231; B65D 2543/0024; B65D 2543/0025; B65D 2543/00268; B65D 2543/00277; B65D 2543/00296; B65D 2543/00305; B65D 2543/00314; B65D 2543/00324; B65D 2543/00333; B65D 2543/00351; B65D 2543/00361; B65D 2543/0037; B65D 2543/00379; B65D 2543/00398; B65D 2543/00407; B65D 2543/00416; B65D 2543/00425; B65D 2543/00435; B65D 2543/00453; B65D 2543/00462; B65D 2543/00481; B65D 2543/0049; B65D 2543/005; B65D 2543/00509; B65D 2543/00518; B65D 2543/00527; B65D 2543/00537; B65D 2543/00546; B65D 2543/00555; B65D 2543/00564; B65D 2543/00574; B65D 2543/00583; B65D 2543/00592; B65D 2543/00611; B65D 2543/0062; B65D 2543/00629; B65D 2543/00638; B65D 2543/00648; B65D 2543/00657; B65D 2543/00685; B65D 2543/00694; B65D 2543/00703; B65D 2543/00731; B65D 2543/0074; B65D 2543/0075; B65D 2543/00759; B65D 2543/00768; B65D 2543/00777; B65D 2543/00796; B65D 2543/00805; B65D 2543/00814; B65D 2543/00824; B65D 2543/00833; B65D 2543/00842; B65D 2543/00851; B65D 2543/0087; B65D 2543/00888; B65D 2543/00898; B65D 2543/00907; B65D 2543/00925; B65D 2543/00935; B65D 2543/00944; B65D 2543/00953; B65D 2543/00972; B65D 2543/00981; B65D 2543/0099; B65D 2547/06; B65D 2547/063; B65D 2547/066; B65D 2565/384; B65D 2565/385; B65D 2565/388; B65D 2571/00018; B65D 2571/00061; B65D 2571/00086; B65D 2571/00111; B65D 2575/583; B65D 2575/586; B65D 2577/043; B65D 2577/2025; B65D 2577/2033; B65D 2577/205; B65D 2577/2058; B65D 2577/2066; B65D 2577/2083; B65D 2577/2091; B65D 2581/3404; B65D 2581/3408; B65D 2581/3409; B65D 2581/3416; B65D 2581/3425; B65D 2581/3427; B65D 2581/3428; B65D 2581/3433; B65D 2581/3436; B65D 2581/3437; B65D 2581/344; B65D 2581/3445; B65D 2581/3455; B65D 2581/3456; B65D 2581/3464; B65D 2581/3466; B65D 2581/3472; B65D 2581/3474; B65D 2581/3477; B65D 2581/3478; B65D 2581/3479; B65D 2581/3489; B65D 2581/3494; B65D 2581/3495; B65D 2581/3497; B65D 2581/3498; B65D 2583/005; B65D 2585/366; B65D 2585/6835; B65D 2585/6837; B65D 2585/88; B65D 2590/0083; B65D 2590/043; B65D 2590/046; B65D 29/00; B65D 29/04; B65D 3/00; B65D 3/02; B65D 3/04; B65D 3/06; B65D 3/10; B65D 3/12; B65D 3/14; B65D 3/20; B65D 3/22; B65D 3/26; B65D 3/263; B65D 3/266; B65D 3/268; B65D 3/30; B65D 31/02; B65D 31/08; B65D 31/10; B65D 31/12; B65D 31/147; B65D 31/16; B65D 33/00; B65D 33/004; B65D 33/01; B65D 33/02; B65D 33/08; B65D 33/14; B65D 33/16; B65D 33/1625; B65D 33/1691; B65D 33/18; B65D 33/20; B65D 33/24; B65D 33/25; B65D 33/2508; B65D 33/2533; B65D 33/2541; B65D 33/2558; B65D 33/30; B65D 33/34; B65D 35/02; B65D 35/06; B65D 35/08; B65D 35/10; B65D 35/14; B65D 35/20; B65D 35/24; B65D 35/28; B65D 35/36; B65D 35/38; B65D 35/40; B65D 35/42; B65D 35/46; B65D 37/00; B65D 39/00; B65D 39/0005; B65D 39/0011; B65D 39/0017; B65D 39/0023; B65D 39/0029; B65D 39/0047; B65D 39/0052; B65D 39/0058; B65D 39/0064; B65D 39/007; B65D 39/0076; B65D 39/0094; B65D 39/02; B65D 39/04; B65D 39/08; B65D 39/082; B65D 39/084; B65D 39/086; B65D 39/088; B65D 39/10; B65D 39/12; B65D 39/16; B65D 41/00; B65D 41/005; B65D 41/02; B65D 41/023; B65D 41/04; B65D 41/0407; B65D 41/0414; B65D 41/0421; B65D 41/0428; B65D 41/0435; B65D 41/0442; B65D 41/045; B65D 41/0457; B65D 41/0464; B65D 41/0471; B65D 41/0478; B65D 41/0485; B65D 41/0492; B65D 41/06; B65D 41/065; B65D 41/08; B65D 41/083; B65D 41/086; B65D 41/10; B65D 41/12; B65D 41/125; B65D 41/14; B65D 41/16; B65D 41/165; B65D 41/17; B65D 41/18; B65D 41/185; B65D 41/205; B65D 41/22; B65D 41/26; B65D 41/265; B65D 41/28; B65D 41/32; B65D 41/325; B65D 41/34; B65D 41/3404; B65D 41/3409; B65D 41/3423; B65D 41/3428; B65D 41/3442; B65D 41/3447; B65D 41/3457; B65D 41/3466; B65D 41/348; B65D 41/349; B65D 41/405; B65D 41/42; B65D 41/44; B65D 41/46; B65D 41/465; B65D 41/48; B65D 41/485; B65D 41/50; B65D 41/58; B65D 41/62; B65D 43/00; B65D 43/02; B65D 43/0202; B65D 43/0204; B65D 43/0206; B65D 43/0208; B65D 43/021; B65D 43/0212; B65D 43/0214; B65D 43/0216; B65D 43/0218; B65D 43/022; B65D 43/0222; B65D 43/0225; B65D 43/0229; B65D 43/0231; B65D 43/0233; B65D 43/0235; B65D 43/0239; B65D 43/0241; B65D 43/0245; B65D 43/0249; B65D 43/0254; B65D 43/0256; B65D 43/0262; B65D 43/0266; B65D 43/0268; B65D 43/0281; B65D 43/0283; B65D 43/06; B65D 43/065; B65D 43/12; B65D 43/14;

B65D 43/16; B65D 43/161; B65D 43/162; B65D 43/163; B65D 43/164; B65D 43/165; B65D 43/167; B65D 43/169; B65D 43/18; B65D 43/20; B65D 43/22; B65D 43/24; B65D 43/26; B65D 43/265; B65D 43/267; B65D 45/02; B65D 45/025; B65D 45/04; B65D 45/06; B65D 45/16; B65D 45/18; B65D 45/20; B65D 45/22; B65D 45/24; B65D 45/28; B65D 45/305; B65D 45/32; B65D 45/322; B65D 45/325; B65D 45/327; B65D 45/345; B65D 47/00; B65D 47/04; B65D 47/043; B65D 47/046; B65D 47/06; B65D 47/061; B65D 47/063; B65D 47/065; B65D 47/066; B65D 47/068; B65D 47/08; B65D 47/0804; B65D 47/0809; B65D 47/0814; B65D 47/0823; B65D 47/0828; B65D 47/0833; B65D 47/0838; B65D 47/0842; B65D 47/0847; B65D 47/0852; B65D 47/0857; B65D 47/0861; B65D 47/0866; B65D 47/0871; B65D 47/0876; B65D 47/088; B65D 47/0885; B65D 47/089; B65D 47/0895; B65D 47/10; B65D 47/103; B65D 47/106; B65D 47/12; B65D 47/121; B65D 47/122; B65D 47/123; B65D 47/125; B65D 47/127; B65D 47/14; B65D 47/141; B65D 47/142; B65D 47/143; B65D 47/147; B65D 47/148; B65D 47/18; B65D 47/20; B65D 47/2006; B65D 47/2012; B65D 47/2018; B65D 47/2025; B65D 47/2031; B65D 47/2037; B65D 47/2043; B65D 47/205; B65D 47/2056; B65D 47/2062; B65D 47/2068; B65D 47/2075; B65D 47/2081; B65D 47/2093; B65D 47/24; B65D 47/242; B65D 47/243; B65D 47/244; B65D 47/245; B65D 47/246; B65D 47/247; B65D 47/248; B65D 47/249; B65D 47/26; B65D 47/261; B65D 47/263; B65D 47/265; B65D 47/266; B65D 47/268; B65D 47/283; B65D 47/286; B65D 47/30; B65D 47/305; B65D 47/32; B65D 47/36; B65D 47/38; B65D 47/40; B65D 47/42; B65D 49/02; B65D 49/04; B65D 49/06; B65D 49/08; B65D 5/00; B65D 5/005; B65D 5/001; B65D 5/0015; B65D 5/0075; B65D 5/008; B65D 5/0085; B65D 5/02; B65D 5/0209; B65D 5/0227; B65D 5/0254; B65D 5/029; B65D 5/06; B65D 5/065; B65D 5/067; B65D 5/068; B65D 5/10; B65D 5/12; B65D 5/14; B65D 5/16; B65D 5/2047; B65D 5/2057; B65D 5/209; B65D 5/22; B65D 5/24; B65D 5/241; B65D 5/28; B65D 5/30; B65D 5/304; B65D 5/32; B65D 5/321; B65D 5/322; B65D 5/326; B65D 5/328; B65D 5/36; B65D 5/3621; B65D 5/40; B65D 5/42; B65D 5/4204; B65D 5/4266; B65D 5/4295; B65D 5/443; B65D 5/445; B65D 5/446; B65D 5/46; B65D 5/46072; B65D 5/4608; B65D 5/48; B65D 5/48024; B65D 5/48026; B65D 5/5028; B65D 5/503; B65D 5/5035; B65D 5/54; B65D 5/5455; B65D 5/546; B65D 5/56; B65D 5/563; B65D 5/566; B65D 5/60; B65D 5/606; B65D 5/62; B65D 5/6602; B65D 5/6632; B65D 5/6638; B65D 5/6644; B65D 5/6661; B65D 5/6664; B65D 5/667; B65D 5/6679; B65D 5/68; B65D 5/685; B65D 5/708; B65D 5/74; B65D 5/742; B65D 5/746; B65D 5/747; B65D 5/748; B65D 50/00; B65D 50/04; B65D 50/041; B65D 50/045; B65D 50/046; B65D 50/06; B65D 50/061; B65D 51/00; B65D 51/002; B65D 51/005; B65D 51/007; B65D 51/10; B65D 51/145; B65D 51/16; B65D 51/1605; B65D 51/1611; B65D 51/1616; B65D 51/1622; B65D 51/1627; B65D 51/1633; B65D 51/1638; B65D 51/1644; B65D 51/165; B65D 51/1661; B65D 51/1666; B65D 51/1672; B65D 51/1677; B65D 51/1683; B65D 51/1688; B65D 51/1694; B65D 51/18; B65D 51/185; B65D 51/20; B65D 51/22; B65D 51/221; B65D 51/222; B65D 51/223; B65D 51/224; B65D 51/225; B65D 51/226; B65D 51/228; B65D 51/24; B65D 51/241; B65D 51/242; B65D 51/243; B65D 51/244; B65D 51/245; B65D 51/246; B65D 51/247; B65D 51/248; B65D 51/249; B65D 51/26; B65D 51/28; B65D 51/2807; B65D 51/2814; B65D 51/2821; B65D 51/2828; B65D 51/2835; B65D 51/2857; B65D 51/2864; B65D 51/2892; B65D 51/30; B65D 51/32; B65D 53/00; B65D 53/02; B65D 53/04; B65D 53/06; B65D 53/08; B65D 55/00; B65D 55/02; B65D 55/022; B65D 55/024; B65D 55/026; B65D 55/028; B65D 55/04; B65D 55/06; B65D 55/08; B65D 55/088; B65D 5/0845; B65D 55/0854; B65D 55/0863; B65D 55/14; B65D 55/145; B65D 55/16; B65D 57/003; B65D 65/02; B65D 65/10; B65D 65/38; B65D 65/40; B65D 65/403; B65D 65/42; B65D 65/46; B65D 65/466; B65D 7/00; B65D 7/04; B65D 7/045; B65D 7/06; B65D 7/22; B65D 7/36; B65D 7/38; B65D 7/40; B65D 7/44; B65D 71/0096; B65D 71/502; B65D 75/00; B65D 75/002; B65D 75/008; B65D 75/12; B65D 75/20; B65D 75/22; B65D 75/26; B65D 75/32; B65D 75/36; B65D 75/366; B65D 75/48; B65D 75/52; B65D 75/525; B65D 75/54; B65D 75/545; B65D 75/566; B65D 75/58; B65D 75/5811; B65D 75/5816; B65D 75/5827; B65D 75/5838; B65D 75/5855; B65D 75/5866; B65D 75/5872; B65D 75/5877; B65D 75/5883; B65D 75/5894; B65D 75/68; B65D 77/00; B65D 77/003; B65D 77/02; B65D 77/04; B65D 77/0406; B65D 77/042; B65D 77/0433; B65D 77/0453; B65D 77/046; B65D 77/048; B65D 77/0486; B65D 77/0493; B65D 77/06; B65D 77/061; B65D 77/062; B65D 77/065; B65D 77/067; B65D 77/08; B65D 77/20; B65D

77/2008; B65D 77/2016; B65D 77/2024; B65D 77/2028; B65D 77/2032; B65D 77/2056; B65D 77/206; B65D 77/208; B65D 77/2088; B65D 77/2096; B65D 77/22; B65D 77/225; B65D 77/24; B65D 77/245; B65D 77/26; B65D 77/28; B65D 77/283; B65D 77/30; B65D 77/32; B65D 79/005; B65D 79/008; B65D 79/0081; B65D 79/0084; B65D 79/0087; B65D 79/02; B65D 81/00; B65D 81/02; B65D 81/022; B65D 81/03; B65D 81/05; B65D 81/051; B65D 81/052; B65D 81/07; B65D 81/127; B65D 81/18; B65D 81/20; B65D 81/2015; B65D 81/202; B65D 81/203; B65D 81/2038; B65D 81/2046; B65D 81/2053; B65D 81/2069; B65D 81/2076; B65D 81/2084; B65D 81/2092; B65D 81/22; B65D 81/24; B65D 81/245; B65D 81/26; B65D 81/261; B65D 81/262; B65D 81/263; B65D 81/264; B65D 81/266; B65D 81/267; B65D 81/268; B65D 81/28; B65D 81/30; B65D 81/32; B65D 81/3205; B65D 81/3211; B65D 81/3216; B65D 81/3222; B65D 81/3227; B65D 81/3233; B65D 81/3238; B65D 81/3244; B65D 81/325; B65D 81/3255; B65D 81/3266; B65D 81/3283; B65D 81/34; B65D 81/3415; B65D 81/343; B65D 81/3438; B65D 81/3446; B65D 81/3453; B65D 81/3461; B65D 81/3476; B65D 81/3484; B65D 81/36; B65D 81/365; B65D 81/38; B65D 81/3806; B65D 81/3813; B65D 81/3816; B65D 81/3818; B65D 81/382; B65D 81/3823; B65D 81/3825; B65D 81/383; B65D 81/3834; B65D 81/3837; B65D 81/3841; B65D 81/3846; B65D 81/3858; B65D 81/386; B65D 81/3862; B65D 81/3865; B65D 81/3867; B65D 81/3869; B65D 81/3874; B65D 81/3876; B65D 81/3881; B65D 81/3886; B65D 81/3893; B65D 81/3897; B65D 83/00; B65D 83/0094; B65D 83/02; B65D 83/04; B65D 83/0409; B65D 83/0445; B65D 83/06; B65D 83/0805; B65D 83/14; B65D 83/141; B65D 83/145; B65D 83/164; B65D 83/20; B65D 83/206; B65D 83/22; B65D 83/24; B65D 83/262; B65D 83/30; B65D 83/303; B65D 83/32; B65D 83/34; B65D 83/36; B65D 83/38; B65D 83/384; B65D 83/386; B65D 83/40; B65D 83/42; B65D 83/425; B65D 83/44; B65D 83/46; B65D 83/48; B65D 83/52; B65D 83/60; B65D 83/62; B65D 83/64; B65D 83/66; B65D 83/673; B65D 83/68; B65D 83/682; B65D 83/687; B65D 83/70; B65D 83/75; B65D 83/7535; B65D 83/76; B65D 83/761; B65D 83/765; B65D 83/768; B65D 83/771; B65D 83/7711; B65D 83/7713; B65D 85/00; B65D 85/10; B65D 85/1027; B65D 85/1045; B65D 85/10568; B65D 85/30; B65D 85/324; B65D 85/34; B65D 85/345; B65D 85/36; B65D 85/38; B65D 85/50; B65D 85/505; B65D 85/52; B65D 85/62; B65D 85/70; B65D 85/72; B65D 85/73; B65D 85/78; B65D 85/80; B65D 85/804; B65D 85/8043; B65D 85/8046; B65D 85/8049; B65D 85/8052; B65D 85/8061; B65D 85/8067; B65D 85/812; B65D 85/816; B65D 85/82; B65D 85/84; B65D 88/027; B65D 88/121; B65D 88/123; B65D 88/126; B65D 88/127; B65D 88/128; B65D 88/14; B65D 88/16; B65D 88/1618; B65D 88/1681; B65D 88/18; B65D 88/26; B65D 88/30; B65D 88/32; B65D 88/548; B65D 88/62; B65D 88/72; B65D 88/745; B65D 90/00; B65D 90/0026; B65D 90/0033; B65D 90/021; B65D 90/022; B65D 90/029; B65D 90/04; B65D 90/041; B65D 90/046; B65D 90/06; B65D 90/08; B65D 90/10; B65D 90/205; B65D 90/22; B65D 90/24; B65D 90/325; B65D 90/34; B65D 90/46; B65D 90/48; B65D 1/326; B65D 17/06; B65D 17/50; B65D 17/507; B65D 17/521; B65D 2217/04; B65D 25/005; B65D 2517/0017; B65D 2517/0031; B65D 2517/004; B65D 2517/5013; B65D 2517/5037; B65D 2555/02; B65D 2565/387; B65D 2575/3245; B65D 2577/2016; B65D 2581/3412; B65D 2581/3431; B65D 2581/3441; B65D 2585/56; B65D 31/04; B65D 33/008; B65D 33/065; B65D 33/28; B65D 41/026; B65D 41/20; B65D 47/44; B65D 5/0005; B65D 5/20; B65D 5/64; B65D 51/2878; B65D 55/0818; B65D 59/06; B65D 71/0085; B65D 71/0088; B65D 75/30; B65D 75/305; B65D 75/326; B65D 75/327; B65D 75/34; B65D 75/38; B65D 75/40; B65D 75/5805; B65D 77/0413; B65D 77/0446; B65D 77/0466; B65D 77/068; B65D 77/2044; B65D 77/2064; B65D 77/38; B65D 81/1075; B65D 81/2023; B65D 81/265; B65D 81/3888; B65D 83/0481; B65D 83/766; B65D 83/767; B65D 85/42; B65D 85/74; B65D 85/76; B65D 85/8055; B65D 85/8058; B65D 85/8064; B65D 85/808; B65D 88/00; B65D 88/025; B65D 88/066; B65D 88/12; B65D 88/28; B65D 88/42; B65D 88/54; B65D 88/66; B65D 88/70; B65D 88/74; B65D 88/744; B65D 88/747; B65D 88/76; B65D 88/78; B65D 90/0093; B65D 90/02; B65D 90/30; B65D 90/32; B65D 90/36; B65D 90/44; B65D 90/501; B65D 90/503; B65D 90/507

USPC .... 215/10, 11.1, 11.3, 11.4, 11.5, 11.6, 12.1, 215/12.2, 13.1, 14, 15, 16, 17, 19, 2, 20, 215/200, 201, 202, 204, 206, 207, 208, 215/209, 21, 211, 213, 214, 215, 216, 215/217, 218, 219, 22, 220, 221, 222, 215/223, 224, 225, 226, 227, 228, 229, 215/23, 230, 231, 232, 233, 235, 236, 215/237, 238, 239, 243, 244, 245, 246, 215/247, 248, 249, 25, 250, 251, 252, 215/253, 254, 255, 256, 257, 258, 26,

215/260, 261, 262, 263, 269, 270, 271, 215/272, 273, 274, 275, 276, 277, 278, 215/28, 280, 282, 283, 284, 285, 287, 215/289, 29, 290, 291, 292, 293, 294, 215/295, 296, 297, 298, 299, 3, 30, 301, 215/302, 303, 304, 305, 306, 307, 308, 215/309, 310, 311, 312, 313, 314, 315, 215/316, 317, 318, 319, 320, 321, 322, 215/323, 324, 325, 326, 327, 328, 329, 215/330, 331, 332, 333, 334, 335, 336, 215/337, 339, 340, 341, 342, 343, 344, 215/345, 346, 347, 348, 349, 350, 351, 215/352, 353, 354, 355, 356, 357, 358, 215/359, 360, 361, 362, 363, 364, 365, 215/366, 370, 371, 372, 373, 375, 378, 215/379, 380, 381, 382, 383, 384, 385, 215/386, 387, 388, 389, 390, 391, 392, 215/394, 395, 396, 398, 399, 4, 40, 400, 215/41, 42, 43, 44, 45, 46, 47, 48, 49, 50, 215/54, 55, 6, 900, 901, 902, DIG. 1, 215/DIG. 3, DIG. 4, DIG. 6, DIG. 7, 215/DIG. 8; 220/203.02

See application file for complete search history.

(56) References Cited

U.S. PATENT DOCUMENTS

| | | | | |
|---|---|---|---|---|
| 5,730,306 | A * | 3/1998 | Costa | B65D 53/04 215/261 |
| 5,803,286 | A * | 9/1998 | Pfefferkorn | B65D 51/1661 215/354 |
| 6,983,857 | B2 * | 1/2006 | Miller | B65D 51/165 215/349 |
| 10,351,320 | B2 * | 7/2019 | Fisch | B65D 51/1616 |
| 2007/0251913 | A1 * | 11/2007 | Mengeu | B65D 51/1644 215/261 |
| 2013/0240531 | A1 * | 9/2013 | Abraham | B65D 51/1616 220/373 |
| 2017/0313483 | A1 * | 11/2017 | Walsh | B65D 51/1616 |
| 2020/0047959 | A1 * | 2/2020 | Kleyn | B32B 5/18 |
| 2020/0216236 | A1 * | 7/2020 | Shah | B65D 53/04 |

* cited by examiner

DISRUPTED CLOSURES FOR CONTAINERS AND METHODS OF MANUFACTURE

FIELD

This disclosure relates to closures, vented closures, methods of manufacture, and combinations thereof.

BACKGROUND

It is often desirable to seal the opening of a container using a seal, sealing member, liner, or inner seal. Often a cap or other closure is screwed or placed over the container opening capturing the sealing member or liner therein. In use, a consumer typically removes the cap or other closure to gain access to the sealing member or liner and then removes or otherwise peels the seal from the container in order to dispense or gain access to its contents. In some forms, the user may puncture the seal to gain access to the interior contents of the container.

Initial attempts at sealing a container opening utilized an induction- or conduction-type inner seal covering the container's opening where the seal generally conformed to the shape of the opening such that a circular container opening was sealed with a round disk approximately the same size as the opening. These prior seals commonly had a lower heat activated sealing layer to secure a periphery of the seal to a rim or other upper surface surrounding the container's opening. Upon exposing the seal to heat, the lower layer bonded to the container's rim. In many cases, these seals included a foil layer capable of forming induction heat to activate the lower heat seal layer.

However, problems still arise with sealing members when the contents of the container require pressure equalization. Sealed gas-tight containers require venting when gas pressure must be equalized between the interior and exterior of the container. Without venting, a flexible gas-tight container will bloat, leak, and possibly burst when the interior pressure exceeds the exterior pressure. Bloating can occur when the contents of the container generates gasses or heat by chemical reaction, for example when the contents include a peroxide-based toothpaste. Bloating can also occur when the container is stored in a heated environment. Similarly, an unvented flexible gas-tight container will collapse when the internal pressure is reduced, for example when atmospheric oxygen is scavenged by one of the ingredients housed in the container. Some modes of transportation put a container at risk of both bursting and collapse. During transport through mountains and valleys, for example, a container is subjected to pressures that can rise above and drop below sea level pressure. Rigid gas-tight containers, such as glass containers, are susceptible to bursting or imploding if the internal and external pressures become sufficiently discrepant.

One way to equalize pressure is to provide a vented liner. Vented liners generally include a gas-permeable filter, or other gas permeable microporous medium, which is interposed on the removable liner. The filter vent permits gases to diffuse in and out of the interior of the container, via the vent aperture, while excluding particulates larger than a threshold size, as well as liquids of a particular range of hydrophobicity. The vented liners are typically removable by the end user, such as be first removing the closure and then removing the vented liner to permit the contents of the container to be dispensed.

However, even when using vented liners, gas must still be permitted to escape from the closure. Many closures are threaded tightly onto containers, trapping the vented liner between the container and a sealing member on the closure. One such sealing member is generally known as a "crab claw" seal area that compresses the vented liner against the rim of the container. This can provide pressure to seal the vented liner against the container, such as during an induction sealing process.

The drawback of the closures described above is that they seal tightly against the vented liner, preventing gases to be exchanged between the vented liner and the outside ambient air. As noted above, the sealing member, such as the crab claw, forms a tight seal that may not permit gas to transfer from the vented liner.

While, in some cases, the sealing member or crab claw can flex or resiliently deform to allow some gas to transfer, the resilient deformation is not consistent and oftentimes not permanent. For example, oftentimes closures are over-torqued or re-torqued on the container such that the crab claw cannot sufficiently deflect to allow gas to escape. Further, during heat sealing, such as induction sealing, too much heat can be supplied which will also prevent the crab claw from sufficiently deflecting. Oftentimes, to provide sufficient gas transfer, perfect conditions would need to exist, with perfect torque and heat supplied. These perfect conditions do not occur consistently. Moreover, variability in the closure design and materials, as well as sealing member design and materials can affect gas transfer from the vented liner. Therefore, it may be desirable to provide a closure with a sealing member that adequately permits gas transfer from a vented liner.

SUMMARY

Closures are described herein which can provide for consistent flow paths for gas transfer from a container. Typically, the closures will also include a vented liner, that can be removable from the container. Further, the closures include a sealing member extending on the inside of the closure to contact the vented liner and/or the rim of the container. The sealing member includes a sealing portion and one or more disruptions in the sealing portion to provide gas pathways to the ambient atmosphere. These disruptions are generally permanent, even when the closure is heated, such as during an induction sealing process. In other words, even when heated, the disruptions will not deform to an extent that the gas flow pathways are closed.

In some forms, a closure for a container is provided. The closure includes a top, a sidewall extending downwardly from a periphery of the top, and a sealing member extending from at least one of the top and sidewall. The sealing member can be annular and have a sealing portion configured to contact a sealing surface when installed on the container. The sealing portion can include at least one disruption in the sealing surface prior to installation on the container to permit fluid to pass between the sealing portion and sealing surface when installed on the container.

In accordance with some forms, a closure for a container is provided. The closure includes a top, a sidewall extending downwardly from a periphery of the top, and a sealing member extending from at least one of the top and sidewall. The sealing member can include a sealing portion and a disrupted portion. The sealing portion can include a sealing cross-sectional profile configured to contact a sealing surface when installed on the container. The disrupted portion can have a cross-sectional profile that is different from the sealing cross-sectional profile creating at least one of a gap and a decreased height compared to the sealing profile prior to installation on the container. The disrupted portion can permit fluid to pass between the sealing member and the sealing surface when installed on the container.

According to some forms, the closure further includes a vented liner positioned adjacent the sealing member within an opening defined by the sidewall.

In some forms, the vented liner includes an opening covered by a vent material permitting gas to flow through the vent material.

In accordance with some forms, the sealing member is at least one of a crab claw seal, annular flange seal, annular plug seal, and combinations thereof.

According to some forms, the sealing member includes at least three disruptions.

In some forms, the sealing surface is at least one of a removable liner and a land area on a rim of the container.

In accordance with some forms, the sealing portion includes a sealing cross-sectional profile, the disrupted portion includes a disruption cross-sectional profile that is different from the sealing cross-sectional profile resulting at least one of a gap and a decreased height compared to the sealing profile prior to installation on the container.

In accordance with some forms, the at least one disruption is a permanent deformation of the sealing member relative to the sealing cross-sectional profile.

In some forms, the at least one disruption is at least about 0.005 inches wide.

According to some forms, the at least one disruption has a width of about 0.005 inches to about 0.040 inches.

In accordance with some forms, the sealing member has a circumference and the at least one disruption is at least about 0.5% of the circumference.

In some forms, a method of manufacturing a closure for a container is provided. The method includes the steps of: providing a closure having a top, a sidewall extending downwardly from a periphery of the top, and a sealing member extending downwardly from at least one of the top and sidewall, the sealing member being annular and having a sealing portion configured to contact a sealing surface when installed on the container; and creating a disruption in the sealing portion of the sealing member, the disruption resulting in at least one of a gap and a decreased height relative to the sealing portion, the disruption permitting fluid to pass between the sealing member and the sealing surface when installed on the container.

These and other aspects may be understood more readily from the following description and the appended drawings.

DETAILED DESCRIPTION

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

For simplicity, this disclosure generally may refer to a container or bottle, but the closures, vented liners, sealing members, and the like described herein may be applied to any type of container, bottle, package or other apparatus having a rim or mouth surrounding an access opening to an internal cavity. In this disclosure, reference to upper and lower surfaces and layers of the components refers to an orientation of the components as generally depicted in figures and with a container in an upright position and having an opening at the top of the container.

Figure 1:
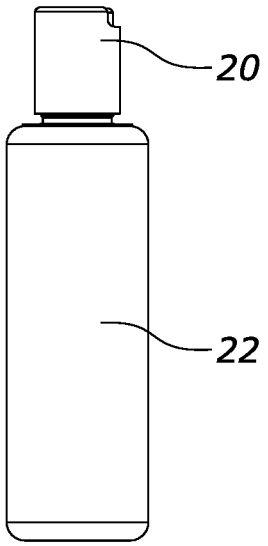
FIG. 1 is a front view of a closure installed on a container.

Referring to FIG. 1, a closure 20 is shown installed on a container 22. As shown in more detail in FIG. 2, the closure 20 can be a dispensing closure 20 that includes a flip top 24. However, it should be appreciated that other types of closures, dispensing closures, and the like may be utilized with the concepts described herein.

Figure 2:
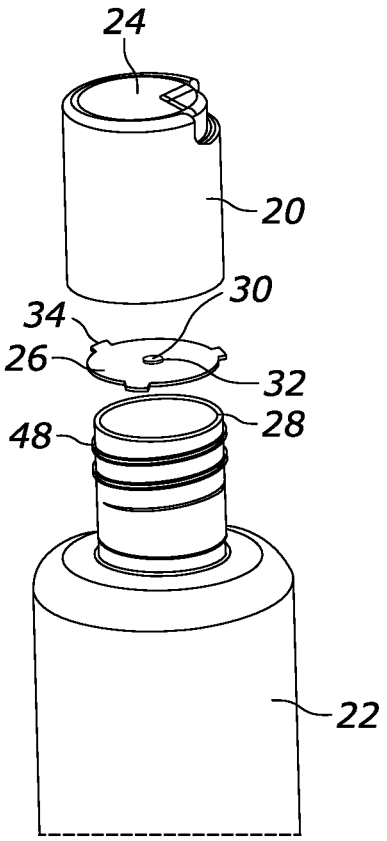
FIG. 2 is an exploded view of a portion of the closure and container of FIG. 1.

In some forms, a liner, such as vented liner 26 can be used to help seal and vent the container 22. In this regard, the vented liner 26 can be used to seal to a rim or land area 28 on the container 22. The vented liner 26 will typically include a sealant layer that seals to the land area 28. The vented liner 26 may also include a vent material 30 covering an opening 32 in the vented liner. The vent material 30 may be configured to allow gas to flow through, but otherwise decrease or prevent other liquid material within the container 22 from passing through. The vented liner 26 may include tabs 34. As shown in FIG. 2, the tabs extend outwardly from the vented liner 26. However, it should be appreciated that other tabs may be used, such as having tabs falling within the circumference of the vented liner 26. Further, in some forms, the vented liner 26 does not include any tabs.

While described above as being used with a vented liner 26, it should be appreciated that other types of liners and seals may also be used with the features described herein. Further, in some forms, the closures can be used without any liner or seal.

Figure 3:
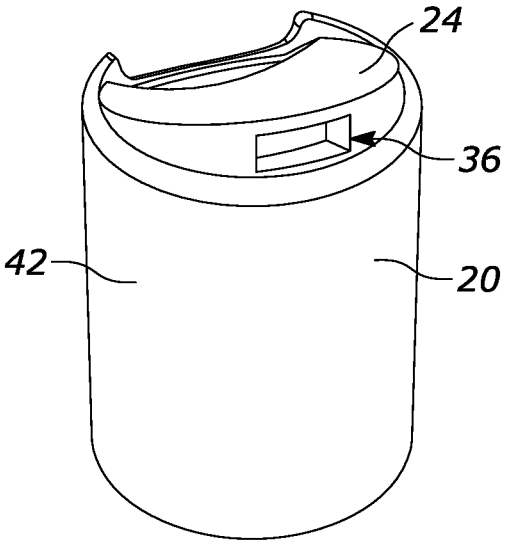
FIG. 3 is a perspective view of one form of a closure.

Turning now to specific details of the closure 20, an open configuration of the closure 20 is shown in FIG. 3. In this form, the flip top 24 is opened so that the contents of the container 22 can be dispensed through outlet 36. Typically, the vented liner 26 would be removed from the container during dispensing to allow liquid to flow easily through the outlet 36.

Figure 4:
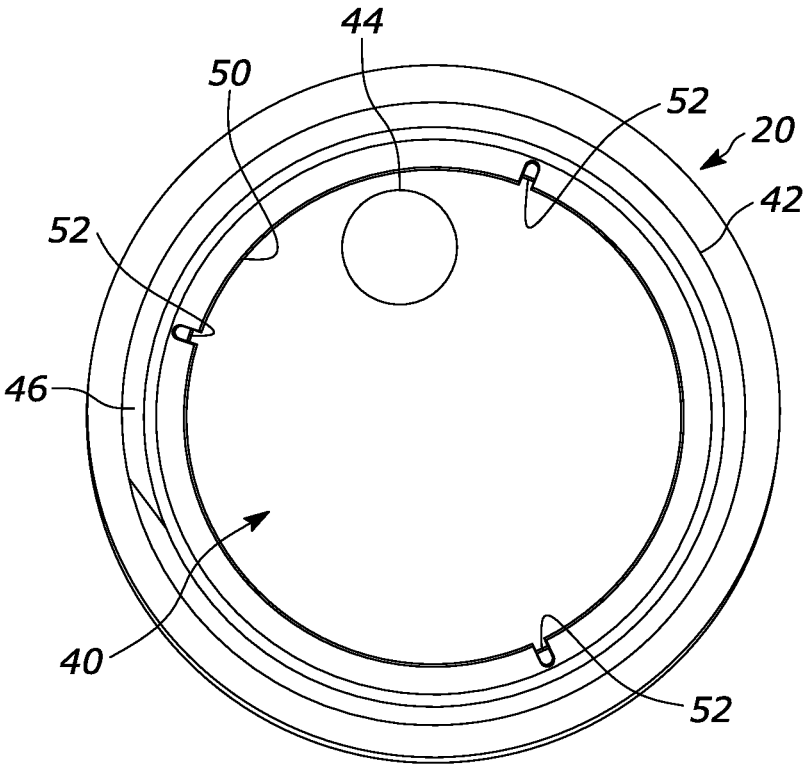
FIG. 4 is a bottom view of a closure having disruptions in the sealing surface.
Figure 5:
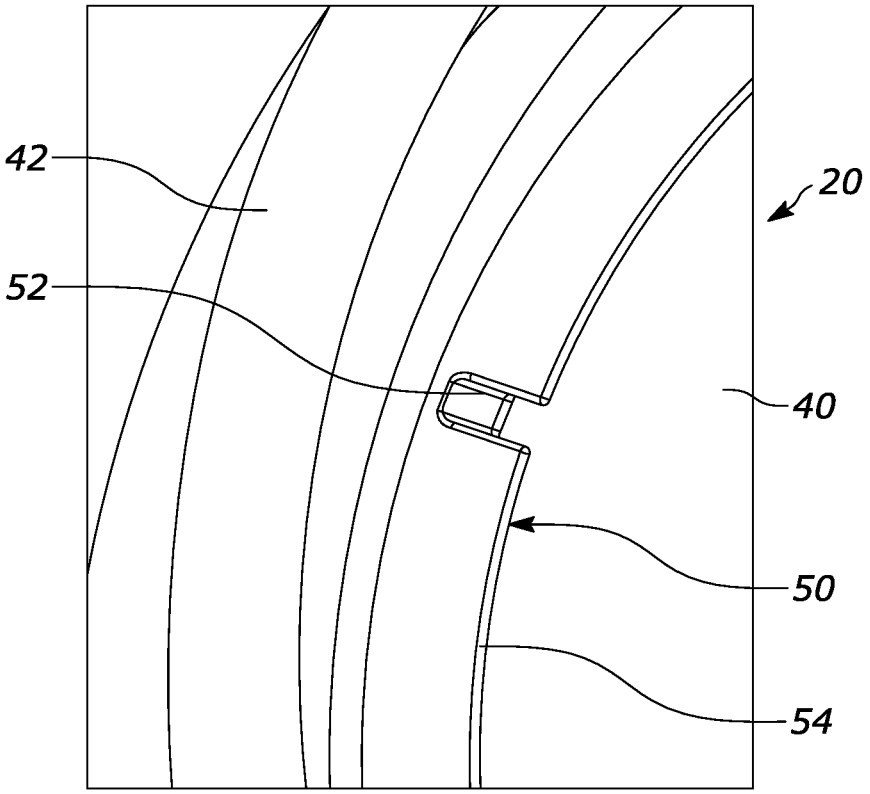
FIG. 5 is an enlarged view of a portion of the closure of FIG. 4

As shown in FIG. 4, the closure 20 includes an upper wall 40 and a sidewall 42 extending downwardly from the upper wall 40. It should be appreciated that the upper wall 40, is not necessarily the top most structure in the closure 20. In fact, as shown in FIGS. 3 and 4, the upper wall 40 is positioned beneath the flip top 24. Further, the sidewall 42 defines an opening 43 whereby the vented liner 26 may be inserted to position the vented liner 26 adjacent the upper wall 40.

In some forms, the upper wall 40 may include an opening 44 that is fluidly connected to the outlet 36 such that the contents in the container 22 can pass through the upper wall 40 and through the outlet 36. The sidewall 42 may also include threads 46 that can cooperate with threads 48 on the container 22 to tighten the closure 20 on the container 22.

The closure 20 also includes a sealing member 50 extending from the upper wall 40. However, it should be understood that the sealing member 50 may extend from any internal structure on the inside of the closure 20, such as, for example, the sidewall 42. In some forms, the sealing member 50 may extend downwardly, such as from the upper wall 40. The sealing member 50 also includes one or more disruptions 52, that will be explained in more detail below. The sealing member 50 generally includes a sealing portion 54 that is interrupted by the disruptions 52. The sealing portion 54 will generally contact at least one of the land area 28 of the container 22 and/or the vented liner 26.

Figure 6:
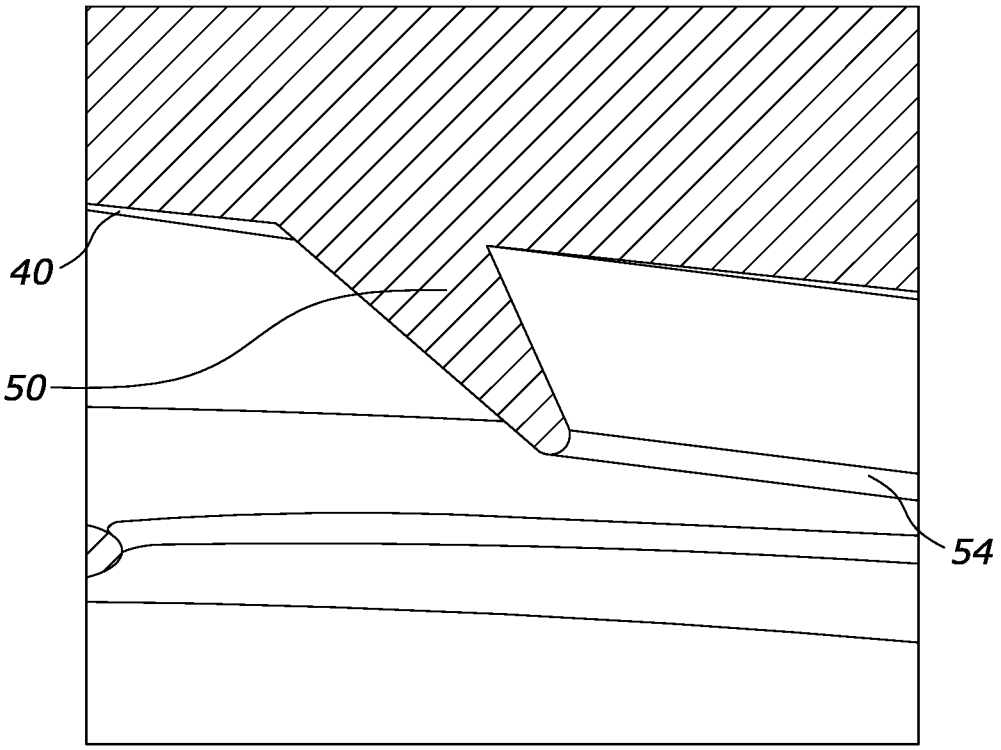
FIG. 6 is a cross-sectional view of the sealing surface of the closure of FIG. 4.

The sealing member 50 may take a variety of different forms. For example, as best seen in FIG. 6 the sealing member 50 is in the form of a "crab claw." Other sealing member shapes, profiles, locations, and the like may also be used. For example, other sealing members include, but are not limited to, annular flange seal, annular plug seal, annular valve seal, and combinations thereof.

Figure 12:
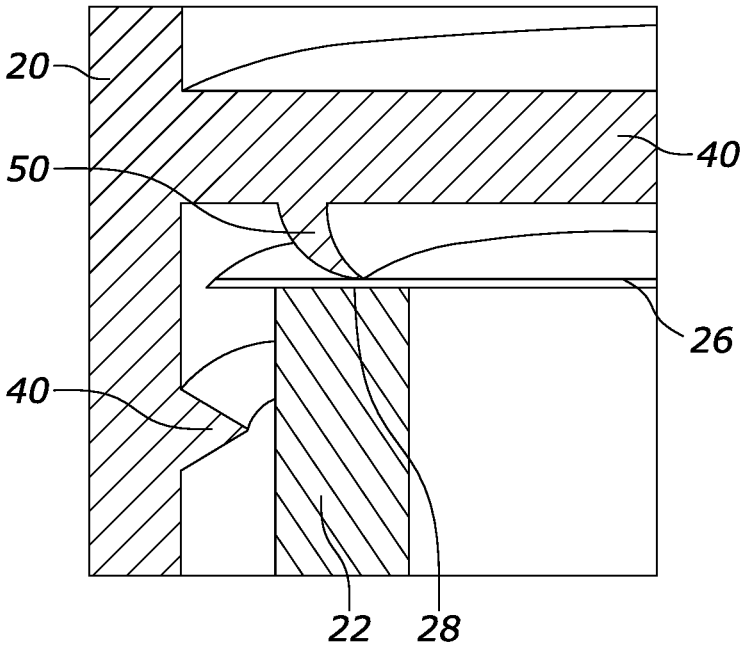
FIG. 12 is a cross-sectional view of a portion of a vented liner and a closure when installed on a container.
Figure 13:
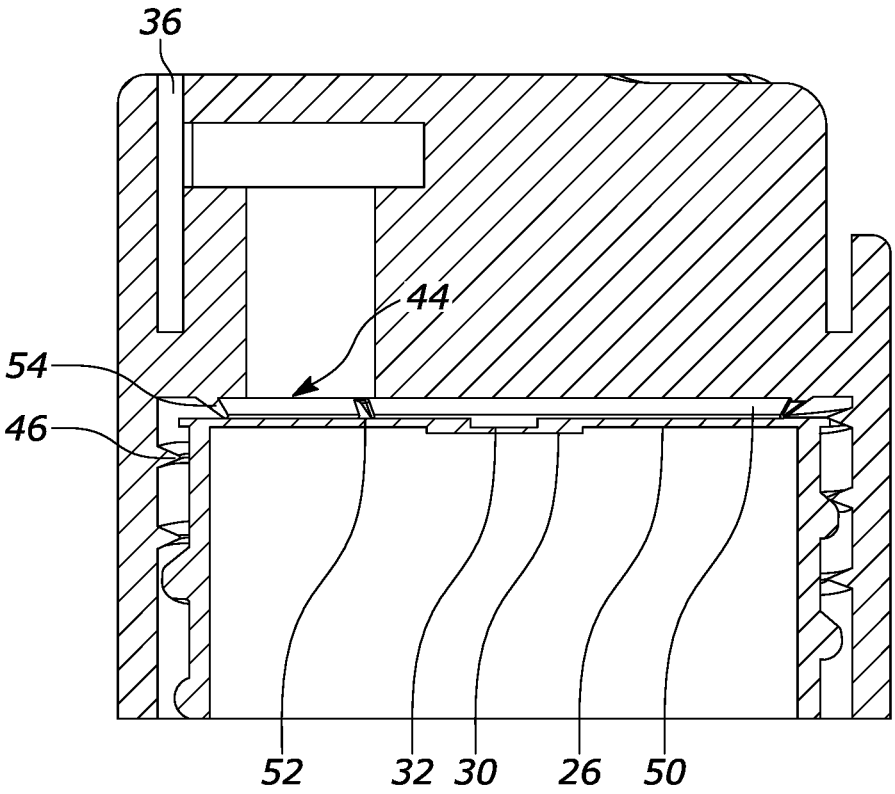
FIG. 13 is a cross-sectional view of another form of vented liner and closure installed on a container.

As shown in FIG. 6, the sealing member 50 includes a cross-sectional profile, which, in this form, resembles a portion of a crab claw, and is the reason the sealing member is referred to a crab claw. The sealing member 50 may be made from a resilient material such that the cross-sectional profile can resiliently deform when the closure 20 is torqued onto the container 22. An example of this resilient deformation is shown in FIG. 12. Other shapes and cross-sectional profiles can be used, such as outlined above regarding the different forms of sealing members.

Figure 7:
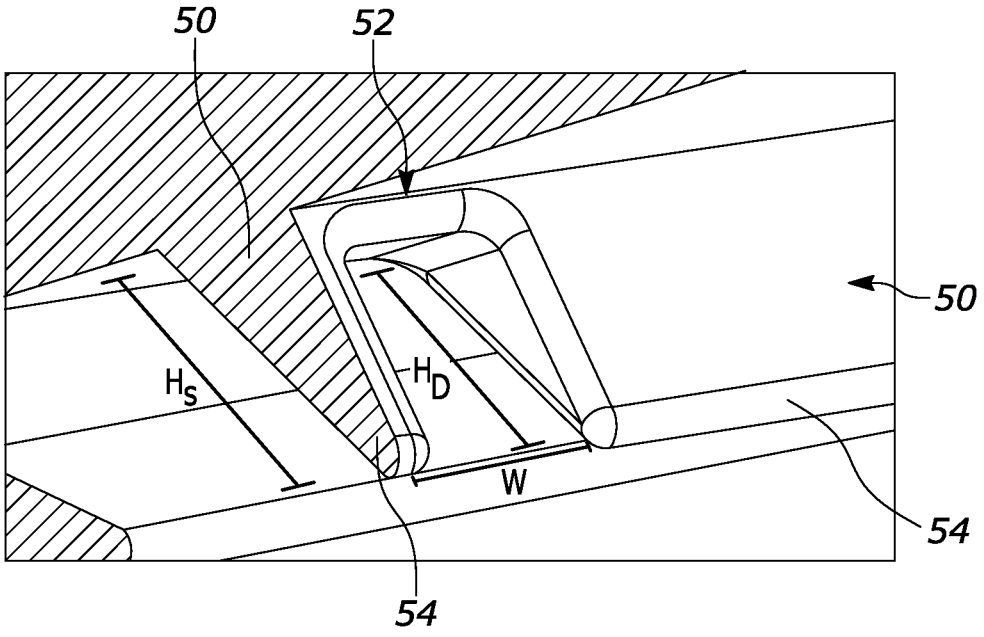
FIG. 7 is a cross-sectional view adjacent a disruption of the sealing surface of the closure of FIG. 4.

As shown in FIG. 4, the sealing member 50 includes three disruptions 52 spaced apart from one another. These disruptions 52 interrupt the cross-sectional profile of the sealing portion 54 of the sealing member 20. This is best seen in FIG. 7, which illustrates the sealing member 50 prior to installation and any potential resilient deformation. The sealing portion 54 generally has a profile with a height $H_S$. The disruption 52, on the other hand, has a smaller height with the difference in height represented by $H_D$. This difference in in height $H_D$ helps create a fluid pathway through the sealing member 50 when the closure 20 is installed on the container 22. Even if the sealing member 50 deforms from having the closure 20 torqued, the difference in height, which may decrease from deflection of the sealing portion 54, still permits gas to flow. Similarly, the disruption 52 may also have a width W to help create the flow path.

Figure 8:
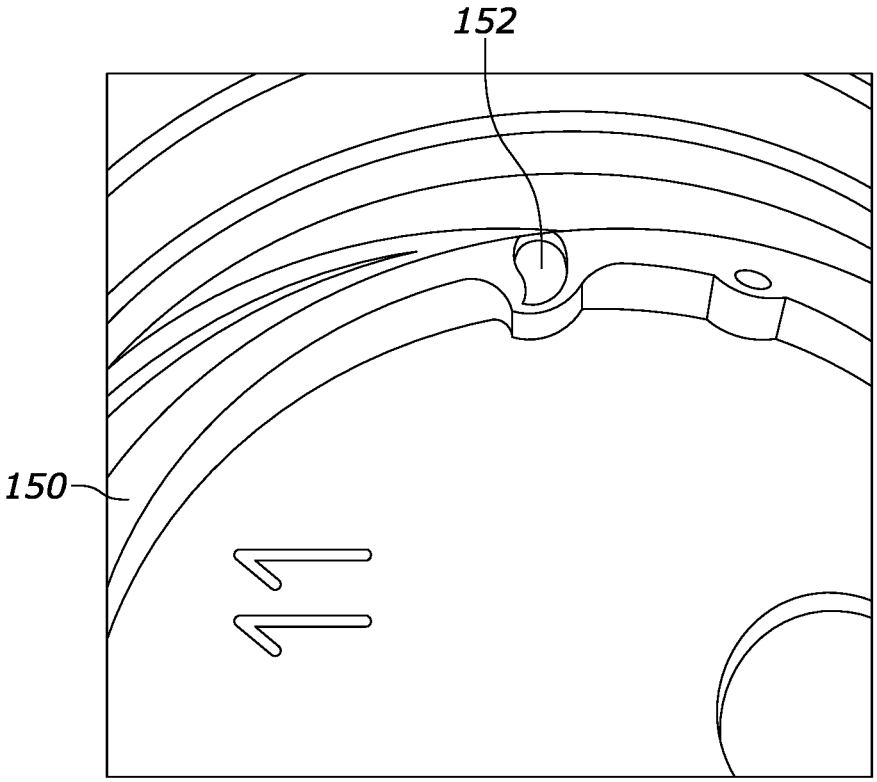
FIG. 8 is a perspective view of another form of disruption in a sealing surface of a closure.
Figure 9:
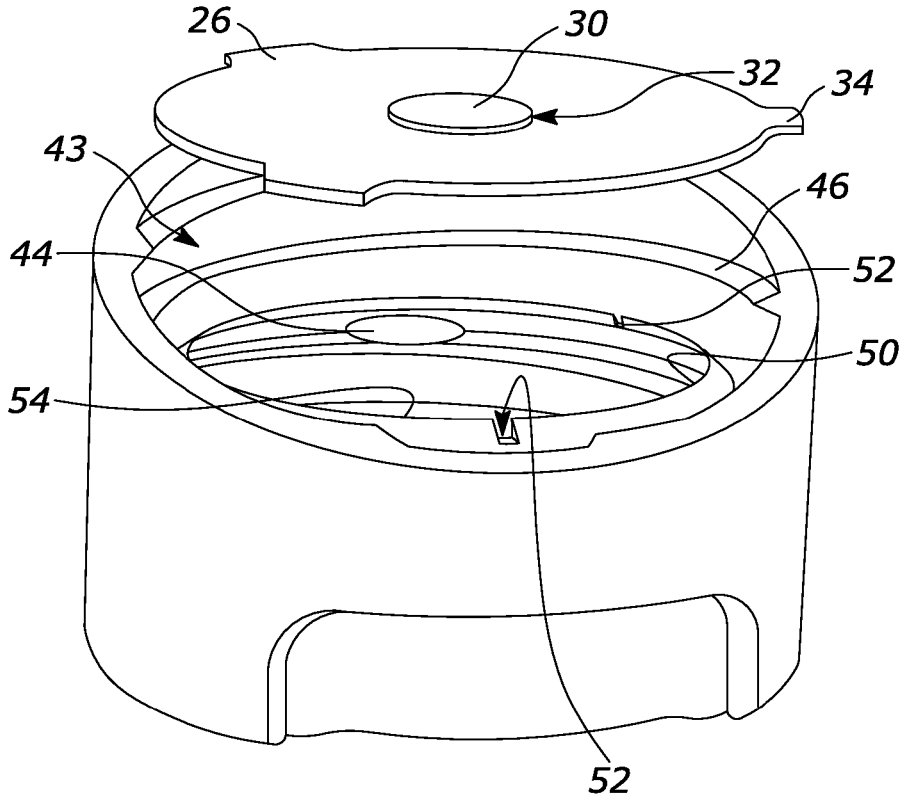
FIG. 9 is a perspective view of a vented liner prior to insertion in a closure.
Figure 10:
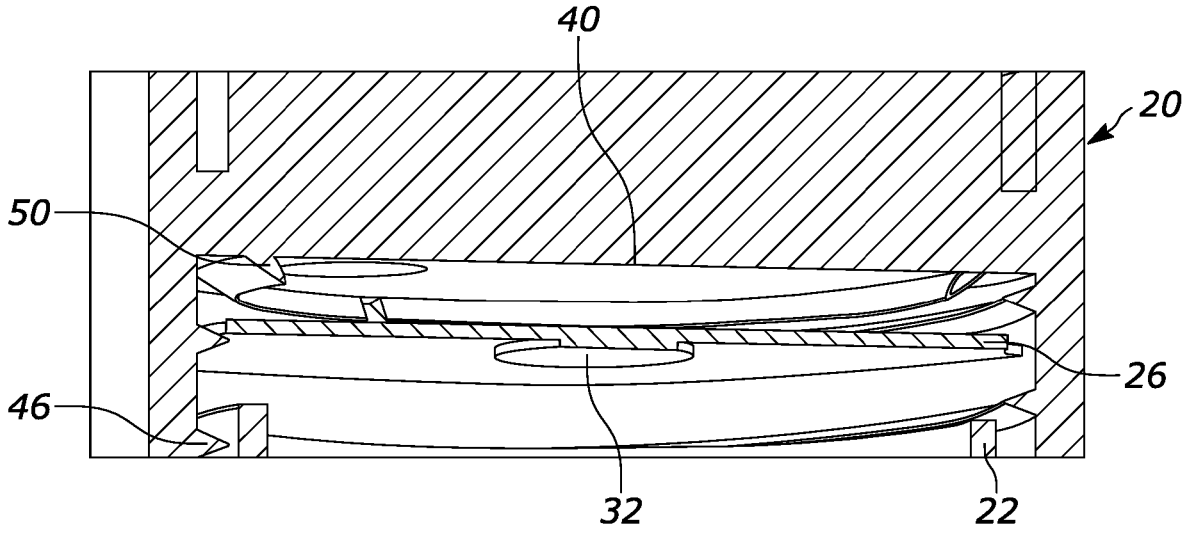
FIG. 10 is a cross-sectional view of a vented liner and closure being installed on a container.
Figure 11:
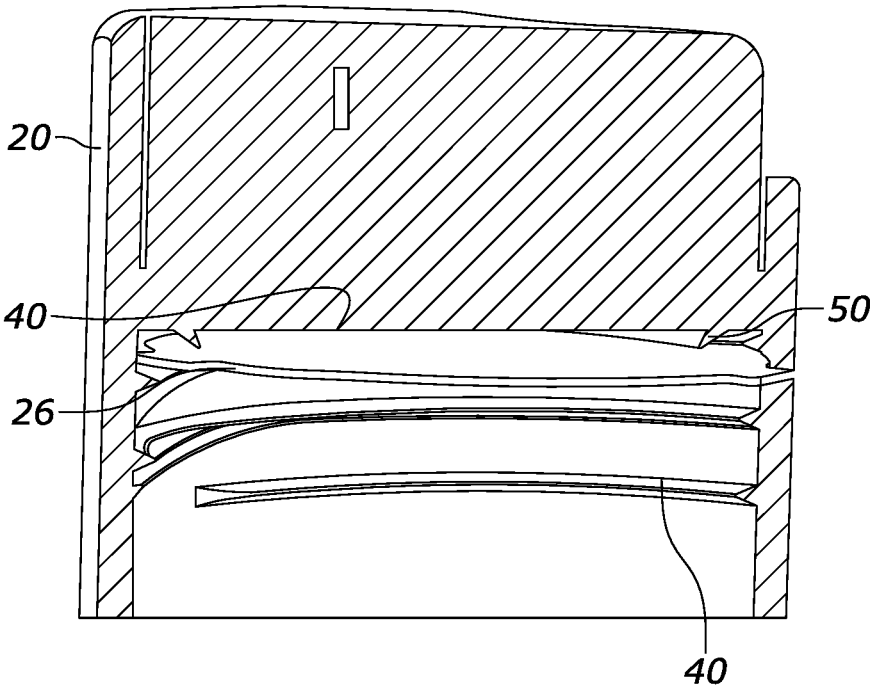
FIG. 11 is a cross-sectional view of a closure and vented liner.

It should be appreciated that the disruption 52 may take a variety of forms including, but not limited to, a slit, nick, compression, or other change to the sealing portion 54 of the sealing member 50. The disruption 52 can have a variety of widths and have differentials in height compared to the sealing portion 54. In one form, the disruption 52 is in the form of a slit, with little to no width, but still permits the sealing portion 54 to form a gap when compressed on the container 22. In other forms, a sealing member 150 includes compressed portions, such as shown in FIG. 8, whereby material is not removed from the sealing member 150, but instead is compressed so as to prevent a disruption 152 from sealing during use. Alternatively, and/or in addition, the disruption 52 can be formed by removing material from the sealing member 50.

The number of disruptions 52 can be varied, as desired. For example, as shown in FIG. 4, there are three disruptions 52 spaced approximately equally apart. Other numbers of disruptions 52 can also be used, such as 1, 2, 3, 4, 5, 6, 7, 8, 9, 10, or more disruptions. The disruptions can also be positioned equidistant from one another or at other relative locations to one another. In some forms, large number of disruptions can be included. For example, 10, 20, 30, 40, 50, 60 70, 80, 90, 100, or more disruptions may be included. The number of disruptions can also be varied, especially in view of the size of the disruptions. For example, if the size is relatively small, such as in the form of a slit, the number may be increased. Similarly, one or more of the disruptions may not be equally spaced from other disruptions. For instance, the disruptions may be located staggered towards one side of the closure. In other form, a larger number of disruptions may be positioned towards one side of the closure such that a remainder of disruptions are generally equally spaced from one another.

The size of the disruptions 52 can also be varied. For example, the height of the disruptions 52 and/or the difference in height compared to the sealing portion 54 can be varied to provide the desired gas flow path. In some instances, prior to installation on the container 22, the difference in height of the disruption 52 compared to the sealing portion 54 is about 0.005 to about 0.040 inches. For example, depending on the material of the sealing member 50, the torque applied to the closure 20, the volume and speed of gas to be exchanged, as well as other factors can influence the size of the disruptions 52. The size of the disruptions may also be made smaller. For example, 0.010, 0.015, 0.020, 0.025, 0.030, 0.035 inches and the like.

Similarly, the width and positioning of the disruptions 52 can be varied. As noted above, the disruptions 52 can be in the form of a slit such that they have little to no width prior to compression when installed on the container 22. In some forms, the disruptions 52 include a width. The width of each disruption 52 can be about 0.005 to about 0.040 inches prior to installation on the container 22. The width, along with the height, can be used to provide for a desired gas flow pathway through the sealing member 50. It should be appreciated that the relative height and width of the disruptions 52 may change when measured prior to installation and then after torquing and installation on the container 22.

The relative amount of gaps provided by the disruptions 52 may also be varied. As noted above, when in the form of slits, the disruptions 52 take up very little, if any of the surface area of the sealing member 50. In some forms, such as in the form of gaps, the disruptions 52 may take up larger portions of the surface area. For example, when in the form of an annular sealing member, the disruptions 52 may account for about 0.05% to about 10% of the circumference of the sealing member 50.

The placement of the disruptions 52 can be varied, as desired. In some forms, the disruptions 52 are placed equidistant from one another. In other forms, one or more of the disruptions 52 may be placed closer to other disruptions 52. For example, disruptions can be placed on a side opposite the outlet 36 so as to provide for gas exchange when product is being dispensed form the container 22.

The sealing member 50 may be made from a variety of different materials. In some forms, the sealing member 50 may be made from the same material as the closure 20. Additionally and/or alternatively, the sealing member 50 includes different materials than the closure 20. The sealing member 50 may be made from material including, but not limited to, rubber, silicone, thermoplastic elastomer, polyethylene, polypropylene, and the like, and combinations thereof.

The size, positioning, and other features of the sealing member 50 and disruptions 52 need to be balanced to provide for desired functionality. For instance, in some forms that include vented liners, the vented liner will typically be removed to dispense material from the container 22. If the disruptions 52 are too large, too many, and/or positioned incorrectly, the contents of the container may leak through the disruptions 52. In other words, the gas flow path through the disruptions 52 must be balanced with the potential for leakage during use. The balance can also be affected by the contents of the container 22. For example, viscous soaps, shampoo, conditioner, and the like are less prone to leak through the disruptions 52 such that larger and more disruptions 52 can be included compared to less viscous materials.

The disruptions 52 are formed prior to installation of the closure 20 on the container 22. In this form, the disruptions 52 are formed in such a manner that they still provide gas flow paths even when torqued and the sealing member 50 is compressed. For example, the disruptions 52 are considered permanent to the extent that the compression and/or heating provided during sealing does not eliminate the gas flow path created by the disruption when installed on the container 22. In other words, the disruptions 52 are considered permanent even if other portions of the sealing member flex or otherwise resiliently deform.

Figure 14:
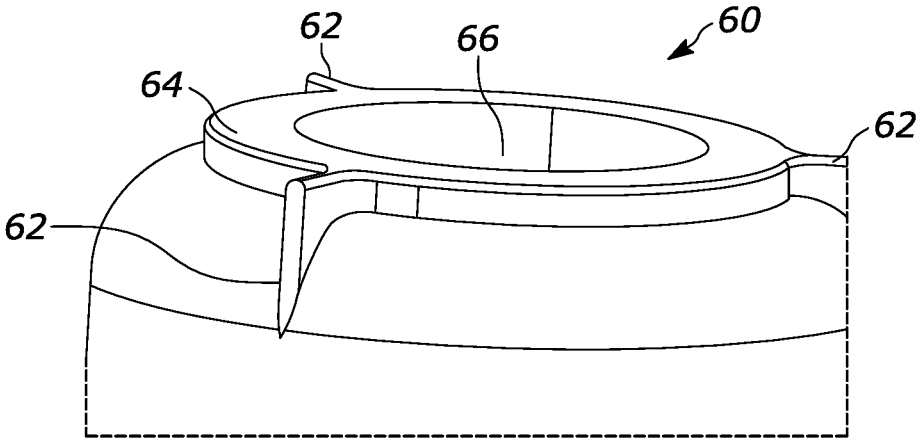
FIG. 14 is a perspective view of a tool used to form disruptions in the sealing portion of a closure.

The disruptions 52 may be manufactured in a variety of different manners. In one form, a disruption can be worked by a punch, laser, and the like to create the gap in the sealing member 50. An exemplary tool is shown in FIG. 14. This tool is in the form of a punch 60 having one or more fins 62. The fins 62 compress and/or tear a portion of the sealing member 50 to create the disruptions 52. The fins 62 extend from a central surface 64 defining a bore or opening 66. The central surface 64 and opening 66 can be used to compress against the closure 20, such as the upper wall 40 without causing excess damage to the closure 20. In other words, force can be focused at the fins 62 on the sealing member 50 without providing focused and/or excess force on other parts of the closure 20, such as the upper wall 40.

Figure 15:
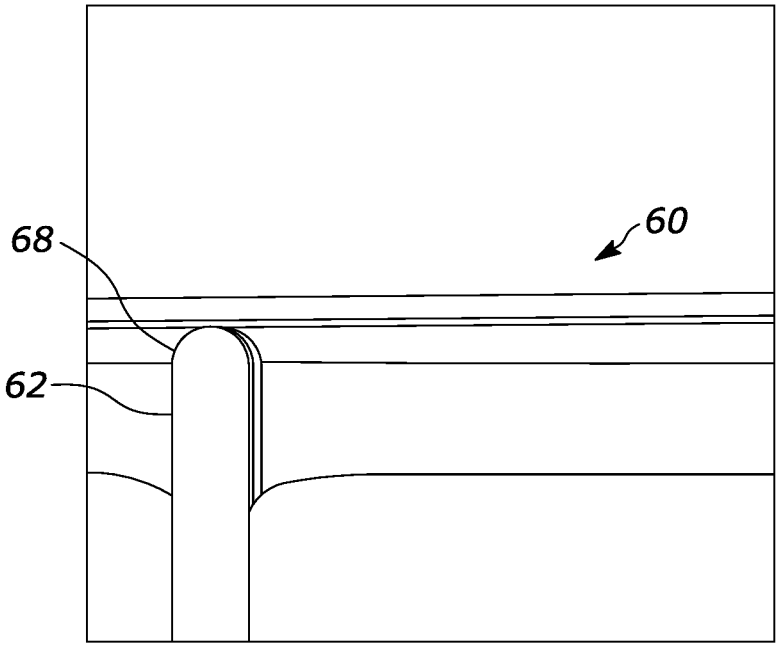
FIG. 15 is an enlarged side view of a portion of the tool of FIG. 14.

Further, the shape of the fins 62 can be designed to provide focused force without causing undue damage or tearing beyond the desired locations of the disruptions 52. Referring to FIG. 15, the fins 62 include generally curved upper surfaces 68. These curved surfaces 68 can provide a more desirable disruption compared to a fin having a square shape. A square shape may result in additional deformation to the sealing portion 54 such that excessive leaking may occur.

In some forms, the tool used to form the disruptions can have protrusions that can be sharp "V" shaped blades to form a slit in the sealing member. According to some forms, the blades can terminate at a sharp point to be able to form the slits. The tool could also have rectangular protrusions that are straight up and down or have angular sides to displace the material in the sealing member. According to some forms, the protrusions can range from 0.005" wide to 0.030" wide. The tool can be made with a single protrusion to form a single disruption or with multiple protrusions to form multiple disruptions. The tool used to form the disruptions can be made from plastic, steel, stainless steel, aluminum, hard coated aluminum, high carbon steel, high carbon stainless steel, titanium, or molybdenum metal alloy.

In some forms, the tool may be heated such that the tool may cause the disruptions to be permanent deformations in the seal. Oftentimes, the closure and/or seal are made from a relatively resilient material such that even after deformation, the deformed portion may resiliently deflect back. However, by heating the tool, the deformations may be permanent.

As noted above, a variety of different liners, vented liners, and the like may be used with the closures described herein. For example, a porous paperboard liner may be used whereby gases are permitted to be exchanged through the porous paperboard, but otherwise restrict fluid flow therethrough. The disruptions 52 can cooperate with such a liner to provide a gas flow path.

Similarly, vented liners can be used, as noted above. In the vented liner, the vent opening extends from a lower surface to an upper surface of liner. In this form, the vent opening provides a passageway for fluid, such as gas, air, and the like, to flow into and/or out of the container. The vent opening is covered with vent material, for example on the top surface, bottom surface, and/or in between the top and bottom surfaces.

The vent material composition can include a variety of different materials to provide the desired venting function. The vent material may comprise a single layer, multiple layers, coatings, and the like. For example, in some forms, the vent material may have a base material, such as an ePTFE material that is then coated on at least one side thereof. In some forms, the vent may include a backing material or may be backless such that just ePTFE is provided.

The vent material choice may also be impacted by the contents of the container. For instance, certain liquids may be more suitable for use with certain types of vent materials. Such vent materials may include, but are not limited to, ePTFE materials, PVDF, nitro cellulose membranes, synthetic paper, and the like. Exemplary materials include, but are not limited to the following: 0.02 micron ePTFE-NW PET backer-oleophobic and hydrophobic coatings, 0.45 micron ePTFE-NW PET backer-oleophobic and hydrophobic coatings, 0.02 micron ePTFE-NW PP backer-oleophobic and hydrophobic coatings, 0.45 micron ePTFE-NW PP backer-oleophobic and hydrophobic coatings, 0.7 micron ePTFE-NW PP backer-oleophobic and hydrophobic coatings, 0.02 micron ePTFE-NW PP/PET backer-oleophobic and hydrophobic coatings, 0.45 micron ePTFE-NW PP/PET backer-oleophobic and hydrophobic coatings, 0.7 micron ePTFE-Delnet backer-oleophobic and hydrophobic coatings, 0.05 micron ePTFE-NW PET backer-oleophobic and hydrophobic coatings, 0.05 micron ePTFE-NW PP backer-oleophobic and hydrophobic coatings, and the like. Other backless forms may also be used.

It should be appreciated that the number and type of layers in the liner can be modified as discussed above. Further, in some forms, the support members may include a single layer, two layers, three layers, four layers, five layers, etc. For example, the support member may include an induction heating layer, such as a metal foil layer, and a polymer film and/or polymer foam layer. In this regard, the induction heating layer can be used in an induction process to provide heat to the sealant layer and the polymer film and/or polymer foam layer can be used as a surface for installing the vent material. In other forms, only a polymer film and/or polymer foam layer may be used without the induction heating layer.

A variety of different vented liners may be used with the closures described herein. One such example is described in WO2023027924 A1, which is incorporated herein by reference. Other vented liners include, but are not limited to, Selig Group's Circumvent™ and Airfoil™ vented liners.

It should be appreciated that the vented liner described herein may be used in a variety of different types of closures. For example, the vented liners may take the form of an induction liner, a conduction liner, a pressure sensitive adhesive liner, as well as other types of liners. The vented liners may also be in the form of a foam liner or sealing member, a flexible film, and the like. The vented liners may also include one or more tabs for removal of the sealing member, as noted above.

It should also be appreciated that the vented liners described herein may be used in a variety of configurations with a variety of different combinations of layers. For example, the sealing members may include polymer foams, films, coextrusions, foils, membranes, adhesives, paper, cardboard, as well as other materials that are used in sealing members. The thicknesses and positions of each of the layers may be modified as desired for a particular application.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A closure for a container, the closure comprising:

an upper wall;

a sidewall extending downwardly from the upper wall; and a sealing member positioned inwardly from the sidewall and extending from at least one of the upper wall and sidewall, the sealing member being annular and having a sealing portion configured to contact a sealing surface when installed on the container, the sealing portion including a plurality of disruptions in the sealing surface prior to installation on the container to permit fluid to pass inward and outward between an interior of the container and the ambient atmosphere between the sealing portion and sealing surface when installed on the container, wherein the plurality of disruptions have a width of about 0.005 inches to about 0.030 inches.

2. The closure of claim 1 further comprising a vented liner positioned adjacent the sealing member within an opening defined by the sidewall.

3. The closure of claim 2, wherein the vented liner includes an opening covered by a vent material permitting gas to flow through the vent material.

4. The closure of claim 1, wherein the sealing member is at least one of a crab claw seal, annular flange seal, annular plug seal, and combinations thereof.

5. The closure of claim 1, wherein the sealing member includes at least three disruptions.

6. The closure of claim 1, wherein the sealing surface is at least one of a removable liner and a land area on a rim of the container.

7. The closure of claim 1, wherein the sealing portion includes a sealing cross-sectional profile, the plurality of disruptions each include a disruption cross-sectional profile that is different from the sealing cross-sectional profile resulting at least one of a gap and a decreased height compared to the sealing cross-sectional profile prior to installation on the container.

8. The closure of claim 7, wherein the plurality of disruptions is a permanent deformation of the sealing member relative to the sealing cross-sectional profile.

9. The closure of claim 1, wherein the closure includes at least ten disruptions.

10. The closure of claim 1, wherein at least some of the disruptions are not equally spaced apart along a circumference of the sealing member.

11. The closure of claim 1, wherein the sealing member has a circumference and the plurality of disruptions occupy at least about 0.5% of the circumference.

12. A closure for a container, the closure comprising:

an upper wall;

a sidewall extending downwardly from the upper wall; and a sealing member positioned inwardly from the sidewall and extending from at least one of the upper wall and sidewall, the sealing member including a sealing portion and a plurality of disrupted portions, the sealing portion including a sealing cross-sectional profile configured to contact a sealing surface when installed on the container, the plurality of disrupted portions having a cross-sectional profile that are different from the sealing cross-sectional profile creating at least one of a gap and a decreased height compared to the sealing cross-sectional profile prior to installation on the container, the plurality of disrupted portions permitting fluid to pass inward and outward between an interior of the container and the ambient atmosphere between the sealing member and the sealing surface when installed on the container, wherein the plurality of disrupted portions have a width of about 0.005 inches to about 0.030 inches.

13. The closure of claim 12 further comprising a vented liner positioned adjacent the sealing member within an opening defined by the sidewall.

14. The closure of claim 13, wherein the vented liner includes an opening covered by a vent material permitting gas to flow through the vent material.

15. The closure of claim 12, wherein the sealing member is at least one of a crab claw seal, annular flange seal, annular plug seal, and combinations thereof.

16. The closure of claim 12, wherein the sealing member includes at least three disrupted portions.

17. The closure of claim 12, wherein the sealing surface is at least one of a removable liner and a land area on a rim of the container.

18. The closure of claim 12, wherein the plurality of disrupted portions are a permanent deformation of the sealing member relative to the sealing cross-sectional profile.

19. The closure of claim 12, wherein the closure includes at least ten disrupted portions.

20. The closure of claim 12, wherein at least some of the disrupted portions are not equally spaced apart along a circumference of the sealing member.

21. The closure of claim 12, wherein the sealing member has a circumference and the plurality of disrupted portions occupy at least about 0.5% of the circumference.

22. A method of manufacturing a closure for a container, the method comprising the steps of:

providing a closure having an upper wall, a sidewall extending downwardly from a periphery of the upper wall, and a sealing member extending downwardly from at least the upper wall and sidewall, the sealing member being annular and having a sealing portion configured to contact a sealing surface when installed on the container; and creating a plurality of disruptions in the sealing portion of the sealing member by using a tool that is heated to cause the plurality of disruptions to be permanent, the plurality of disruptions resulting in at least one of a gap and a decreased height relative to the sealing portion, the plurality of disruptions permitting fluid to pass inward and outward between an interior of the container and the ambient atmosphere between the sealing member and the sealing surface when installed on the container.

23. The method of claim 22 further comprising the step of inserting a vented liner into an opening defined by the sidewall.

* * * * *